US005186849A

United States Patent [19]

Toya et al.

[11] Patent Number: 5,186,849

[45] Date of Patent: Feb. 16, 1993

[54] SILICONE GREASE COMPOSITION

[75] Inventors: Masanori Toya; Hideo Takahashi; Yasuji Matsumoto, all of Tokyo, Japan

[73] Assignee: Toshiba Silicone Ltd., Tokyo, Japan

[21] Appl. No.: 798,175

[22] Filed: Nov. 26, 1991

[30] Foreign Application Priority Data

Nov. 30, 1990 [JP] Japan ..... 2-330041
Jan. 14, 1991 [JP] Japan ..... 3-16030

[51] Int. Cl.[5] ..... C10M 113/08; C10M 113/06

[52] U.S. Cl. ..... 252/21; 252/19; 252/26; 252/27; 252/49.7

[58] Field of Search ..... 252/19, 21, 26, 27

[56] References Cited

U.S. PATENT DOCUMENTS

| | | | |
|---|---|---|---|
| 2,890,170 | 6/1959 | Ragborg | 252/21 |
| 4,102,852 | 7/1978 | Delatorre et al. | 260/37 SB |
| 4,701,272 | 10/1987 | Mori et al. | 252/21 |
| 5,037,563 | 8/1991 | Pink et al. | 252/18 |

OTHER PUBLICATIONS

Noll, W., Production of Technical Silicone Products from Polyorganosiloxanes, "Chemistry and Technology of Silicones", 1968.

MacLaury, M., The Influence of Platinum Fillers and Cure on the Flammability of Peroxide Cured Silicone Rubber, Journal of Fire and Flammability, vol. 10, 1979, pp. 175-198.

*Primary Examiner*—Ellen McAvoy
*Attorney, Agent, or Firm*—Sughrue, Mion, Zinn, Macpeak & Seas

[57] ABSTRACT

A silicone grease composition comprising:

(A) 100 parts by weight of a polyorganosiloxane containing at least two silicon-bonded vinyl groups per molecule and having a viscosity at 25° C. of from 10 to 1,000,000 cSt;

(B) from 10 to 200 parts by weight of a filler comprising at least one member selected from the group consisting of calcium carbonate, zinc carbonate, a composite zinc white, and silica; and (C) from 0.001 to 0.1 part by weight of platinum or a platinum compound.

10 Claims, 1 Drawing Sheet

SILICONE GREASE COMPOSITION

FIELD OF THE INVENTION

The present invention relates to a silicone grease composition. More particularly, the invention relates to a silicone grease composition for high-voltage insulated devices which, when applied to the inside of the anode cap of a cathode-ray tube for television or for other use or applied to a cathode-ray tube surface in contact with the anode cap, shows good electrical insulating properties without swelling of the anode.

BACKGROUND OF THE INVENTION

In general, insulation of high-voltage junctions in cathode-ray tubes employed in television sets and other devices is attained by a method in which, as shown in the Drawing, a silicone grease 8 is applied to the interface between an anode cap 5 made of silicone rubber and a cathode-ray tube 1 to thereby prevent moisture infiltration and maintain good electrical insulation.

However, conventional silicone greases have had a problem that since they show good compatibility with silicone rubbers constituting the anode caps, silicone oils contained in the silicone greases penetrate into the silicone rubbers to swell the rubbers and, as a result, sealing of the high-voltage junctions is impaired. Hence, there has been proposed a method for suppressing the compatibility with silicone rubbers by increasing the molecular weight of silicone oils which are base oils of the silicone greases as disclosed in, for example, JP-B-U-53-52376. (The term "JP-B-U" as used herein means an "examined Japanese utility model publication".)

Further, in view of the fact that a silicone grease based on a methyl alkyl silicone oil containing an alkyl group other than methyl shows low compatibility with a dimethyl silicone rubber, thus reducing swelling of the rubber, such silicone grease has been used.

On the other hand, since television sets recently have frequently caused fires, there is a growing trend toward use of flame-retardant materials for parts of television sets. For example, a flame-retardant grease comprising a vinyl group-containing silicone oil and a platinum compound is known as a silicone grease for a cable filler as disclosed in, for example, JP-A-63-235398. (The term "JP-A" as used herein means an "unexamined published Japanese patent application".) Further, the silicone greases used for the electrical insulation and moisture-proof sealing of anode caps also have been required to have the flame-retardant properties. Therefore, development of a silicone grease having reduced swelling properties to the silicone rubbers and good flame retardant properties is demanded.

SUMMARY OF THE INVENTION

As a result of intensive studies to develop such a silicone grease, it has been found that flame retardant properties can be imparted to a silicone base oil by incorporating vinyl groups thereinto and adding a platinum compound thereto, and that the flame retardant properties of the silicone grease using this base oil can be further enhanced by incorporating a filler such as calcium carbonate, zinc carbonate, a composite zinc white, silica, or the like into the grease at a high loading. It has also been found that by incorporating phenyl or perfluoroalkyl groups into the base oil or by increasing the of the base oil, the above silicone grease can minimize the swelling of the silicone rubber without impairing the flame retardant properties thereof. The present invention has been completed based on these findings.

Accordingly, one object of the present invention is to provide a silicone grease composition having excellent flame retardant properties and reduced swelling properties to silicone rubbers, thereby eliminating the above-described problems.

Another object of the present invention is to provide a high-voltage insulated device showing good electrical insulating properties.

The silicone grease composition in accordance with the present invention comprises:

(A) 100 parts by weight of a polyorganosiloxane containing at least two silicon-bonded vinyl groups per molecule and having a viscosity at 25° C. of from 10 to 1,000,000 cSt;

(B) from 10 to 200 parts by weight of a filler comprising at least one member selected from the group consisting of calcium carbonate, zinc carbonate, a composite zinc white, and silica; and (C) from 0.001 to 0.1 part by weight of platinum or a platinum compound.

The high-voltage insulated device in accordance with the present invention comprises a device having high-voltage junctions covered with electrically insulating silicone rubber caps, wherein an inner face of the silicone rubber caps or a surface of the high-voltage junctions is coated with the above-described silicone grease composition.

BRIEF DESCRIPTION OF THE DRAWING

The Drawing is a partially sectional view of a junction of a cathode-ray tube and an anode cap.

In the Drawing, numeral 1 denotes a cathode-ray tube, 2 a cathode-ray tube clamp, 3 carbon black, 4 a cavity cap, 5 an anode cap, 6 a high-voltage lead wire, 7 an anode cap connecting terminal, and 8 a silicone grease.

DETAILED DESCRIPTION OF THE INVENTION

Figure 1:
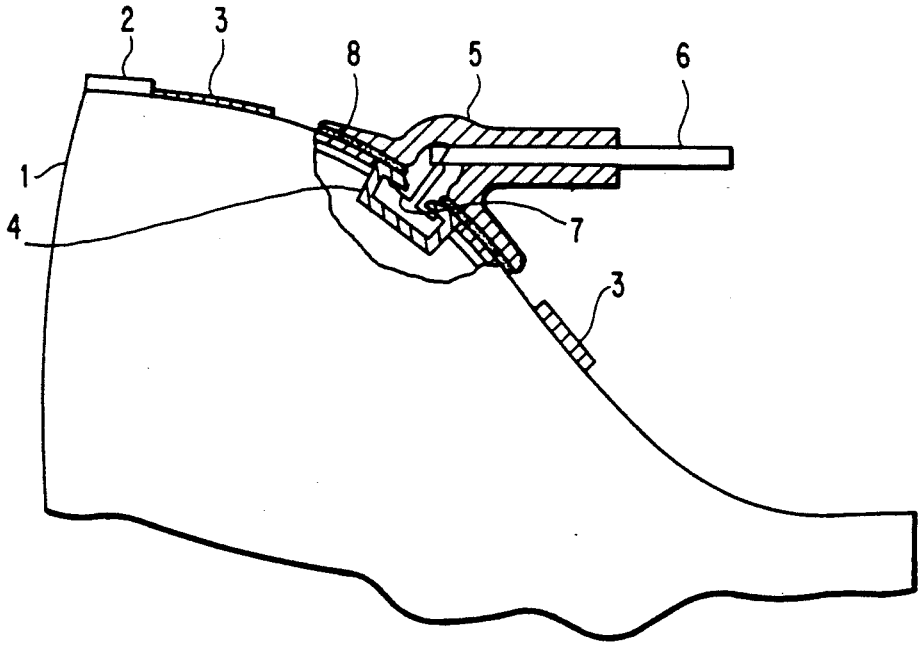

The polyorganosiloxane, component (A), used in the present invention is a base polymer of the composition of the present invention and contains at least two silicon-bonded vinyl groups per molecule. If the number of silicon-bonded vinyl group per molecule is below 2, the effect of imparting flame retardant properties to the base polymer is weakened greatly. Further, from the standpoint of good flame retardant properties, the amount of the vinyl groups is 0.1 mol% or more per mol of all the organic groups, and in order to maintain good heat resistance of the grease, the amount thereof is 30 mol% or less. The particularly preferred amount of the vinyl groups is 0.2 to 1.0 mol%. It is preferred that the polyorganosiloxane contains a phenyl group or a perfluoroalkyl group because incorporation of these groups makes the base polymer minimize swelling of the silicone rubbers constituting anode caps. From the standpoint of swelling-preventive effect, the amount of these groups incorporated in the base polymer is preferably 10 mol% or more per mole of all the organic groups contained in the polymer. Further, from the standpoints of ease of base polymer synthesis and preventing the base polymer from becoming highly viscous and hence having poor workability, the amount of these groups incorporated is preferably 50 mol% or less, more preferably from 20 to 40 mol%.

Examples of perfluoroalkyl-containing groups include $CF_3CH_2CH_2$—, $CF_3CF_2CH_2CH_2$—, $CF_3(CF_2)_2CH_2CH_2$—, $CF_3(CF_2)_3CH_2CH_2$—, $CF_3(CF_2)_5CH_2CH_2$—, and the like.

The base polymer can contain both a phenyl group and such a perfluoroalkyl group.

Examples of other possible substituent groups include an alkyl group such as methyl, ethyl, and propyl, a cycloalkyl group such as cyclohexyl, an alkenyl group such as allyl, an aryl group such as tolyl, groups formed by substituting part or all of the carbon-bonded hydrogen atoms in these groups with halogen atoms, and a hydroxyl group. Of these, methyl is preferred as the other substituent group from the standpoint of the easy synthesis of the base polymer.

The polyorganosiloxane, component (A), has a viscosity (as measured at 25° C.; hereinafter the same) of from 10 to 1,000,000 cSt. If the viscosity thereof is below 10 cSt, the grease obtained using such a polyorganosiloxane tends to suffer oil separation. If it exceeds 1,000,000 cSt, the resulting grease becomes exceedingly viscous and, hence, has poor workability. Preferably, the viscosity of component (A) is in the range of from 50 to 500,000 cSt.

The particularly preferred range of the viscosity of component (A) is from 50,000 to 500,000 cSt, because use of component (A) having a viscosity in this range enables the grease composition to minimize swelling of the silicone rubbers constituting anode caps and to have good flame retardant properties.

The silicone grease composition of the present invention can suppress swelling of a silicone rubber-made anode cap by selecting substituents in the base polymer or adjusting the viscosity thereof. For example, in the case that the silicone grease composition of the present invention is applied to a sheet-like silicone rubber and aged under conditions of, e.g., 120° C. and 1 week, it is preferred to prepare the silicone grease composition such that the volume change on swelling of the sheet-like silicone rubber is 10% or less, more preferably 5% or less.

The filler, component (B), used in the present invention serves to improve flame retardant properties of the composition, and comprises at least one member selected from the group consisting of calcium carbonate, zinc carbonate, a composite zinc white, and silica. The filler is used in the form of a powder. Although the powder particles of the filler are not particularly limited in size and shape, it is preferred that the filler is in a fine powder form with an average particle diameter of from 0.05 to 50 μm from the standpoint of consistency and long-term stability of the grease composition. Examples of the calcium carbonate include heavy calcium carbonate, light calcium carbonate, and a surface-treated calcium carbonate obtained by treating the surfaces of heavy or light calcium carbonate particles with a fatty acid salt or other treating agent. The composite zinc white comprises particles each composed of a core of calcium carbonate and a shell which is a zinc oxide or zinc carbonate layer covering the core, and the method for producing the composite zinc white is known as disclosed in, for example, JP-A-49-29300 and JP-A-49-130893.

The amount of component (B) added to the silicone grease composition is from 10 to 200 parts by weight per 100 parts by weight of component (A). If the amount of component (B) added is below 10 parts by weight, not only does the resulting grease not have sufficient flame retardant properties, but also the grease is not suitable for practical use because it has excessively high consistency and flowability. On the other hand, if the amount thereof exceeds 200 parts by weight, the resulting grease has too low a consistency and becomes very hard, resulting in poor workability.

The silicone grease composition of the present invention has a consistency of preferably 150 to 400 and more preferably 200 to 350 as measured according to, for example, JIS K2220, from the standpoint of good workability.

Use of calcium carbonate, zinc carbonate, or a composite zinc white, particularly calcium carbonate, as component (B) is preferred because these fillers are especially effective in enhancing flame retardant properties. In the case of using zinc carbonate or a composite zinc white, it is preferred to use them in combination with calcium carbonate. In this case, it is especially preferred that the calcium carbonate constitutes from 20 to 80 wt% of component (B).

If silica is used as component (B) and the polyorganosiloxane to be used therewith as component (A) has a high viscosity, it is preferred to use silica surface-treated with a silicone or silane, because such a surface-treated silica enables the resulting grease to have an appropriate consistency.

Component (C) used in the present invention is platinum or a platinum compound. Examples thereof include metallic platinum such as platinum black, and platinum compounds such as chloroplatinic acid, alcohol-modified chloroplatinic acid, complexes of platinum and olefins, complexes of platinum and ketones, complexes of platinum and vinylsiloxanes, complexes of platinum and phosphorus, and the like. Of these, complexes of platinum and phosphorus are preferred from the standpoint of enhancing flame retardant properties.

The amount of component (C) added is from 0.001 to 0.1 part by weight per 100 parts by weight of component (A). If the amount thereof is below 0.001 part by weight, sufficient flame retardant properties cannot be obtained. Further, an amount exceeding 0.1 part by weight is not preferred in that even if component (C) is added in such a large amount, the flame retardant properties of the grease composition cannot be improved any more. The preferred amount of the component (C) is from 0.002 to 0.02 part by weight.

The silicone grease composition of the present invention can exhibit good flame-retardant properties by blending a platinum compound and a specific filler, or using a silicone base polymer having a high viscosity. For example, the silicone grease composition is prepared to have flame-retardant properties of preferably 15 seconds or less and more preferably 10 seconds or less as measured according to, for example, UL 94.

The composition of the present invention can be obtained by uniformly mixing the three components, (A) to (C), in amounts within the respective ranges specified above. A consistency improver (thickener) may be added to the composition. Examples of the consistency improver include fillers such as silica powder, alumina, iron oxide, zinc white and carbon, and surface-treated fillers obtained by surface-treating these fillers with an alkoxysilane or other silane compounds. Further, a greasifying agent or an antioxidant may also be added.

If required and necessary, mixing of these components may be conducted with heating or under a reduced pressure, and the resulting mixture may be further homogenized by means of a three-roll mill, colloid mill, or the like to obtain a grease.

As described above, the silicone grease composition of the present invention has excellent flame retardant properties due to use as the base oil of a silicone oil which has been made flame-retardant by the incorporation of vinyl groups therein and by the addition of a platinum catalyst thereto and also the further inclusion of a filler comprising at least one member selected from the group consisting of calcium carbonate, zinc carbonate, a composite zinc white, and silica. The silicone grease composition can minimize swelling of the silicone rubber by incorporating a phenyl group or a perfluoroalkyl group into the silicone oil. Therefore, the composition of the present invention is extremely useful as an electrically insulating and moistureproof sealing material for the anode caps of cathode-ray tubes for use in television sets or in other electrical or electronic devices.

The present invention is explained below in more detail by reference to the following examples, but the invention is not construed as limiting thereto. In the examples, all parts are by weight unless otherwise indicated.

EXAMPLES 1 TO 8 AND COMPARATIVE EXAMPLES 1 TO 5

To 100 parts of each of various kinds of polyorganosiloxanes in which the vinyl group content, phenyl group content, perfluoroalkyl group contents, and viscosities are shown in Table 1 were added a filler shown in Table 1 and a complex of chloroplatinic acid and phosphoric acid (platinum content 6 wt%) in respective amounts shown in Table 1. Each of the resulting mixtures was kneaded by means of a three-roll mill, thereby preparing silicone grease compositions having consistencies as shown in Table 2. The thus-obtained grease compositions were subjected to a burning test and a swelling test. The results obtained are shown in Table 2.

Burning test

A glass sleeve having an inner diameter of 2 mm and a length of 5 mm is filled with a grease sample and hung down perpendicularly, and a flame is then applied thereto from the lower side thereof for 1 second. The time period from removal of the applied flame to self-extinguishment is measured. (This test is conducted in accordance with the burning test as prescribed by UL 94.)

Swelling test

A cured silicone rubber (TSE2184-U, for anode cap use, manufactured by Toshiba Silicone Co., Ltd.) is shaped into a sheet having a width of 25 mm, a length of 50 mm, and a thickness of 2 mm, a grease sample is applied thereon at a thickness of 1 mm, and the resulting sheet is then aged at 120° C. for 1 week. After the aging, the volume change on swelling of the silicone rubber sheet is measured.

TABLE 1

| | Base Oil | | | | | Filler | | Platinum Compound |
|---|---|---|---|---|---|---|---|---|
| | Kind | Viscosity (cSt) | Phenyl content (mol %) | Fluoroalkyl content (mol %) | Vinyl content (mol %) | Kind | Amount (parts) | Amount (parts) |
| Example 1 | Methylphenylsiloxane | 500 | 35 | 0 | 0.3 | Calcium carbonate*2 | 100 | 0.004 |
| Example 2 | Methylphenylsiloxane | 1,500 | 40 | 0 | 0.2 | Calcium carbonate*2 | 100 | 0.010 |
| Example 3 | Methylphenylsiloxane | 1,000 | 20 | 0 | 0.2 | Calcium carbonate*3 | 150 | 0.010 |
| Example 4 | Methylphenylsiloxane | 10,000 | 35 | 0 | 0.3 | Calcium carbonate*2 | 150 | 0.004 |
| Example 5 | Methylphenylsiloxane | 1,000 | 40 | 0 | 0.3 | Calcium carbonate*2/ zinc carbonate*4 | 90/10 | 0.010 |
| Example 6 | Methylphenylsiloxane | 1,000 | 40 | 0 | 0.2 | Calcium carbonate*2/ composite zinc white*5 | 90/10 | 0.010 |
| Example 7 | Fluorosiloxane*8 | 1,000 | 0 | 20 | 0.2 | Calcium carbonate*2 | 100 | 0.010 |
| Example 8 | Dimethylsiloxane | 100,000 | 0 | 0 | 0.5 | Calcium carbonate*2 | 100 | 0.010 |
| Example 9 | Dimethylsiloxane | 100,000 | 0 | 0 | 0.5 | Silica powder*7 | 15 | 0.010 |
| Comparative Example 1 | Dimethylsiloxane | 1,000 | 0 | 0 | 0.2 | Calcium carbonate*2 | 100 | 0.010 |
| Comparative Example 2 | Dimethylsiloxane | 1,000 | 0 | 0 | 0.2 | Silica powder*7 | 15 | 0.010 |
| Comparative Example 3 | Methylphenylsiloxane | 1,000 | 40 | 0 | 0.2 | Silica powder*6 | 15 | 0 |
| Comparative Example 4 | Methylalkylsiloxane | 1,000 | 0 | 0 | 0 | Calcium carbonate*2 | 100 | 0.010 |
| Comparative Example 5 | Methylalkylsiloxane | 1,000 | 0 | 0 | 0 | Silica powder*6 | 15 | 0.010 |

*1Containing 40 mol % of octyl group as alkyl group.
*2Light and fine calcium carbonate (surface-untreated, average particle diameter 0.19 μm, trade name "Hakuenka A", manufactured by Shiraishi Kogyo Co., Ltd., Japan).
*3Gluey calcium carbonate (treated with fatty acid, average particle diameter 0.12 μm, trade name "Hakuenka CCR", manufactured by Shiraishi Kogyo Co., Ltd.).
*4Average particle diameter 0.5 μm.
*5Average particle diameter 0.3 μm (trade name "FINE-Z", manufactured by KOMESHO SEKKAI KOGYO CO., LTD., Japan).
*6Fumed silica (surface-untreated, trade name "Aerosil 200", manufactured by Nippon Aerosil Co., Ltd., Japan).
*7Fumed silica (surface-treated with dimethyldichlorosilane, trade name "R-972", manufactured by Nippon Aerosil Co., Ltd.).
*8Containing $CF_3CF_2C_2H_4$— as fluoroalkyl group, with other organic groups being methyl.

TABLE 2

| | Consistency (Cone penetration) (JIS K 2220) | Swelling test (Volume change on swelling) (%) | Burning Test (Burninq time) (sec) |
|---|---|---|---|
| Example 1 | 250 | 2.2 | 2 |
| Example 2 | 280 | 2.0 | 0 |
| Example 3 | 250 | 2.5 | 3 |
| Example 4 | 250 | 2.1 | 2 |
| Example 5 | 270 | 2.0 | 3 |
| Example 6 | 260 | 2.0 | 5 |
| Example 7 | 250 | 3.0 | 2 |
| Example 8 | 260 | 7.0 | 3 |
| Example 9 | 300 | 6.5 | 12 |
| Comparative Example 1 | 280 | 15.0 | 5 |
| Comparative Example 2 | 290 | 14.0 | 25 |

TABLE 2-continued

| | Consistency (Cone penetration) (JIS K 2220) | Swelling test (Volume change on swelling) (%) | Burning Test (Burninq time) (sec) |
|---|---|---|---|
| Comparative Example 3 | 330 | 2.0 | Burned |
| Comparative Example 4 | 280 | 1.0 | Burned |
| Comparative Example 5 | 330 | 1.0 | Burned |

Table 2 shows that the compositions of the present invention exhibit good flame retardant properties and low swelling properties to silicone rubber.

While the invention has been described in detail and with reference to specific embodiments thereof, it will be apparent to one skilled in the art that various changes and modifications can be made therein without departing from the spirit and scope thereof.

What is claimed is:

1. A silicone grease composition comprising:

(A) 100 parts by weight of a polyorganosiloxane containing at least two silicon-bonded vinyl groups per molecule and having a viscosity at 25° C. of from 10 to 1,000,000 cSt;

(B) from 10 to 200 parts by weight of a filler comprising at least one member selected from the group consisting of calcium carbonate, zinc carbonate and a composite zinc white; and (C) from 0.001 to 0.1 part by weight of platinum or a platinum compound.

2. A silicone grease composition as claimed in claim 1, wherein component (A) contains phenyl group in an amount of from 10 to 50 mol% per mole of all the organic groups in component (A).

3. A silicone grease composition as claimed in claim 1, wherein component (A) contains a perfluoroalkyl group in an amount of from 10 to 50 mol% per mole of all the organic groups in component (A).

4. A silicone grease composition as claimed in claim 1, wherein component (A) has a viscosity at 25° C. of from 50,000 to 500,000 cSt.

5. A silicone grease composition as claimed in claim 1, wherein said filler is a composite zinc white.

6. A high-voltage insulated device containing high-voltage junctions covered with electrically insulating silicone rubber caps, wherein an inner face of the cap or a surface of the junction is coated with a silicone grease composition comprising:

(A) 100 parts by weight of a polyorganosiloxane containing at least two silicon-bonded vinyl groups per molecule and having a viscosity at 25° C. of from 10 to 1,000,000 cSt;

(B) from 10 to 200 parts by weight of a filler comprising at least one member selected from the group consisting of calcium carbonate, zinc carbonate and a composite zinc white; and (C) from 0.001 to 0.1 part by weight of platinum or a platinum compound.

7. A high-voltage insulated device as claimed in claim 6, wherein component (A) contains phenyl group in an amount of from 10 to 50 mol% per mole of all the organic groups in component (A).

8. A high-voltage insulated device as claimed in claim 6, wherein component (A) contains a perfluoroalkyl group in an amount of from 10 to 50 mol% per mole of all the organic groups in component (A).

9. A high-voltage insulated device as claimed in claim 6, wherein component (A) has a viscosity at 25° C. of from 50,000 to 500,000 cSt.

10. A high-voltage insulated device as claimed in claim 6, wherein said filler is a composite zinc white.

* * * * *